US010176945B2

(12) United States Patent
Domejean et al.

(10) Patent No.: US 10,176,945 B2
(45) Date of Patent: Jan. 8, 2019

(54) DC ELECTRICAL CIRCUIT BREAKER

(71) Applicant: Schneider Electric Industries SAS, Rueil Malmaison (FR)

(72) Inventors: Eric Domejean, Voreppe (FR); Loic Rondot, Gieres (FR); Stephane Dye, Vatilieu (FR)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 0 days.

(21) Appl. No.: 15/471,237

(22) Filed: Mar. 28, 2017

(65) Prior Publication Data

US 2017/0301490 A1 Oct. 19, 2017

(30) Foreign Application Priority Data

Apr. 15, 2016 (FR) ..... 16 53346

(51) Int. Cl.

| | |
|---|---|
| ***H01H 33/18*** | (2006.01) |
| ***H01H 33/08*** | (2006.01) |
| ***H01H 9/44*** | (2006.01) |
| ***H01H 1/20*** | (2006.01) |
| ***H01H 77/10*** | (2006.01) |
| ***H01F 1/055*** | (2006.01) |

(52) U.S. Cl.

CPC ..... *H01H 33/182* (2013.01); *H01F 1/055* (2013.01); *H01H 9/443* (2013.01); *H01H 9/446* (2013.01);

(Continued)

(58) Field of Classification Search

CPC .... H01H 33/08; H01H 33/182; H01H 33/187; H01H 33/596; H01H 9/443; H01H 9/446;

(Continued)

(56) References Cited

U.S. PATENT DOCUMENTS 5,313,180 A * 5/1994 Vial ..... H01H 1/205 335/16
6,281,459 B1 * 8/2001 Munsch ..... H01H 77/108 218/22

(Continued)

FOREIGN PATENT DOCUMENTS

| | | | |
|---|---|---|---|
| DE | 10 2014 015 061 | A1 | 4/2015 |
| EP | 2 980 821 | A1 | 2/2016 |
| FR | 2 632 772 | A1 | 12/1989 |

OTHER PUBLICATIONS

French Preliminary Search Report dated Dec. 5, 2016, in French Application 16 53346 filed on Apr. 15, 2016 (with English Translation of Categories of Cited Documents).

*Primary Examiner* — Renee Luebke
*Assistant Examiner* — William Bolton
(74) *Attorney, Agent, or Firm* — Oblon, McClelland, Maier & Neustadt, L.L.P.

(57) ABSTRACT

A DC electrical circuit breaker includes first and second movable electrical contacts. The circuit breaker includes a magnetic circuit including a magnet and generating a magnetic field able to guide an electrical arc in the direction of a quenching chamber, and having for this purpose curved field lines extending perpendicularly to opposite lateral walls of an electrical arc formation chamber, these field lines converging, in a central region of the arc formation chamber containing the contact zones, toward the quenching chamber while extending parallel to the longitudinal plane.

15 Claims, 4 Drawing Sheets

(52) U.S. Cl.
CPC ..... *H01H 33/08* (2013.01); *H01H 77/108* (2013.01); *H01H 1/2041* (2013.01)

(58) Field of Classification Search
CPC ..... H01H 77/108; H01H 73/18; H01H 50/00; H01H 1/2041
USPC ..... 218/26, 30, 31, 24, 32, 43, 149; 335/296, 297
See application file for complete search history.

(56) References Cited

U.S. PATENT DOCUMENTS

| | | | | |
|---|---|---|---|---|
| 8,193,881 | B2 * | 6/2012 | Yuba | H01H 9/443 335/78 |
| 8,222,983 | B2 * | 7/2012 | Zhou | H01H 9/443 335/201 |
| 2001/0027961 | A1 * | 10/2001 | Brouillat | H01H 9/302 218/154 |
| 2004/0227603 | A1 * | 11/2004 | Ciarcia | H01H 1/2058 335/202 |
| 2008/0030289 | A1 * | 2/2008 | Kralik | H01H 9/34 335/201 |
| 2013/0105444 | A1 | 5/2013 | Prohaska et al. | |
| 2014/0061160 | A1 | 3/2014 | Juds et al. | |
| 2014/0253264 | A1 * | 9/2014 | Eberts | H01H 9/30 335/16 |
| 2015/0114934 | A1 | 4/2015 | Juds et al. | |
| 2015/0243458 | A1 * | 8/2015 | Britz | H01H 33/182 218/25 |

* cited by examiner

DC ELECTRICAL CIRCUIT BREAKER

The invention relates to an air-quenched DC electrical circuit breaker exhibiting improved electric arc quenching power.

Air-quenched DC electrical circuit breakers are known, which comprise electrical contacts, connected to input and output terminals for the electric current and being selectively displaceable with respect to one another between a closed position, in which respective contact zones of the first and second electrical contacts are in contact with one another so as to permit the flow of the DC electric current between the first and second electrical contacts, and an open position, in which these contact zones are remote from one another.

In a known manner, these circuit breakers make it possible to protect electrical systems against abnormal conditions, such as an electrical surge or a short-circuit, by rapidly interrupting the flow of the electric current when such an abnormal condition is detected. By "rapidly" is meant that the electric current must be interrupted in less than 100 ms or, preferably, less than 10 ms after detection of the abnormal condition.

To interrupt the flow of the current, the conductors are parted from one another towards their open position. Typically, an electric arc then forms between their contact zones. This arc must be extinguished in order to interrupt the flow of the electric current. In practice, for electric currents of high intensity, for example greater than some ten amperes, the electric arc is displaced by blowing in the direction of an arc quenching chamber, where it is extinguished, thus making it possible to interrupt the flow of the current. Such a blowing effect is in part caused by an electromagnetic force exerted on the electric arc, under the effect of the magnetic field created by the flow of the electric current in the electric arc itself. However, in the presence of an electric current of lower intensity, for example less than or equal to ten amperes or to one ampere, the magnetic field generated by the electric arc itself is not sufficient to displace it by blowing towards the quenching chamber. The electric arc may then persist for a long time between the two electrical contact zones. This is not desirable, since the circuit breaker does not rapidly interrupt the flow of the current, this possibly causing a situation adverse to safety.

FR 2 632 772 B1 discloses a circuit breaker in which a permanent magnet is disposed on an arc horn at the entrance of the quenching chamber, in such a way as to generate a constant magnetic field so as to displace an electric arc towards the quenching chamber whatever the value of the electric current. Such a device is not however entirely satisfactory and moreover is complicated to produce industrially and requires sometimes significant modifications of the existing circuit breakers for its integration.

It is these drawbacks that the invention is more particularly intended to remedy by proposing a DC electrical circuit breaker with reversible polarity in which an electric arc can be interrupted reliably even for low values of intensity of electric currents, and that can be produced industrially in a simple manner.

For this purpose, the invention relates to a DC electrical circuit breaker, comprising:

- first and second input and output terminals for a DC electric current,
- first and second electrical contacts, linked respectively to the first and second terminals and being selectively displaceable with respect to one another, along a longitudinal plane of the circuit breaker, between:
  - a closed position, in which respective contact zones of the first and second electrical contacts are in contact with one another so as to permit the flow of the DC electric current between the first and second electrical contacts, and
  - an open position, in which these contact zones are remote from one another,
- an electric arc formation chamber, in which the contact zones are placed;
- an electric arc quenching chamber;

The circuit breaker furthermore comprises a magnetic circuit including a magnet and generating a magnetic field which is able to guide, in the direction of the quenching chamber, an electric arc forming between the contact zones in the open position, the magnetic field generated by the magnetic circuit exhibiting for this purpose curved field lines which extend essentially perpendicularly to opposite lateral walls of the electric arc formation chamber, these lateral walls being disposed on either side of the contact zones essentially parallel to the longitudinal plane, these field lines converging, at the level of a central region of the arc formation chamber containing the contact zones, towards the quenching chamber while extending parallel to the longitudinal plane.

By virtue of the invention, the magnetic field created by the magnet and by the magnetic circuit exerts a force on the electric arc which displaces firstly the latter away from the electrical contact zones and perpendicularly to the longitudinal plane. On account of the configuration of the magnetic field lines, the force exerted on the electric arc then changes direction, so as subsequently to direct the electric arc towards the quenching chamber. On account of the symmetric configuration with respect to the longitudinal plane, the electric arc is displaced towards the quenching chamber regardless of the direction of flow of the electric current in the circuit breaker. Moreover, the magnetic circuit is easily integratable into existing circuit breakers, without subjecting them to significant structural modification.

According to advantageous but non obligatory aspects of the invention, such a circuit breaker can incorporate one or more of the following features, taken in any technically admissible combination:

- The magnetic circuit furthermore comprises a magnetic core made of a ferromagnetic material and which extends at least partly along the first electrical contact, the magnet being placed at one of the ends of the magnetic core.
- The magnet exhibits a magnetic axis oriented parallel to a longitudinal direction contained in the longitudinal plane.
- The spacing between the magnet and the end of the magnetic core is less than or equal to 2 mm or, preferably, less than or equal to 1 mm, or else preferably zero.
- The magnet is a permanent magnet.
- The magnet is made of a synthetic alloy containing an element from the rare earth family, for example a samarium-cobalt alloy.
- The magnet is able to generate a magnetic field of greater than or equal to 0.5 tesla or, preferably, greater than or equal to 1 tesla.
- The magnetic core is made of steel or iron.
- The lateral walls are made of a ferromagnetic material.

The invention will be better understood and other advantages of the latter will be more clearly apparent in the light of the following description, of an embodiment of a circuit breaker, and given solely by way of example and with reference to the appended drawings in which.

Figure 1:
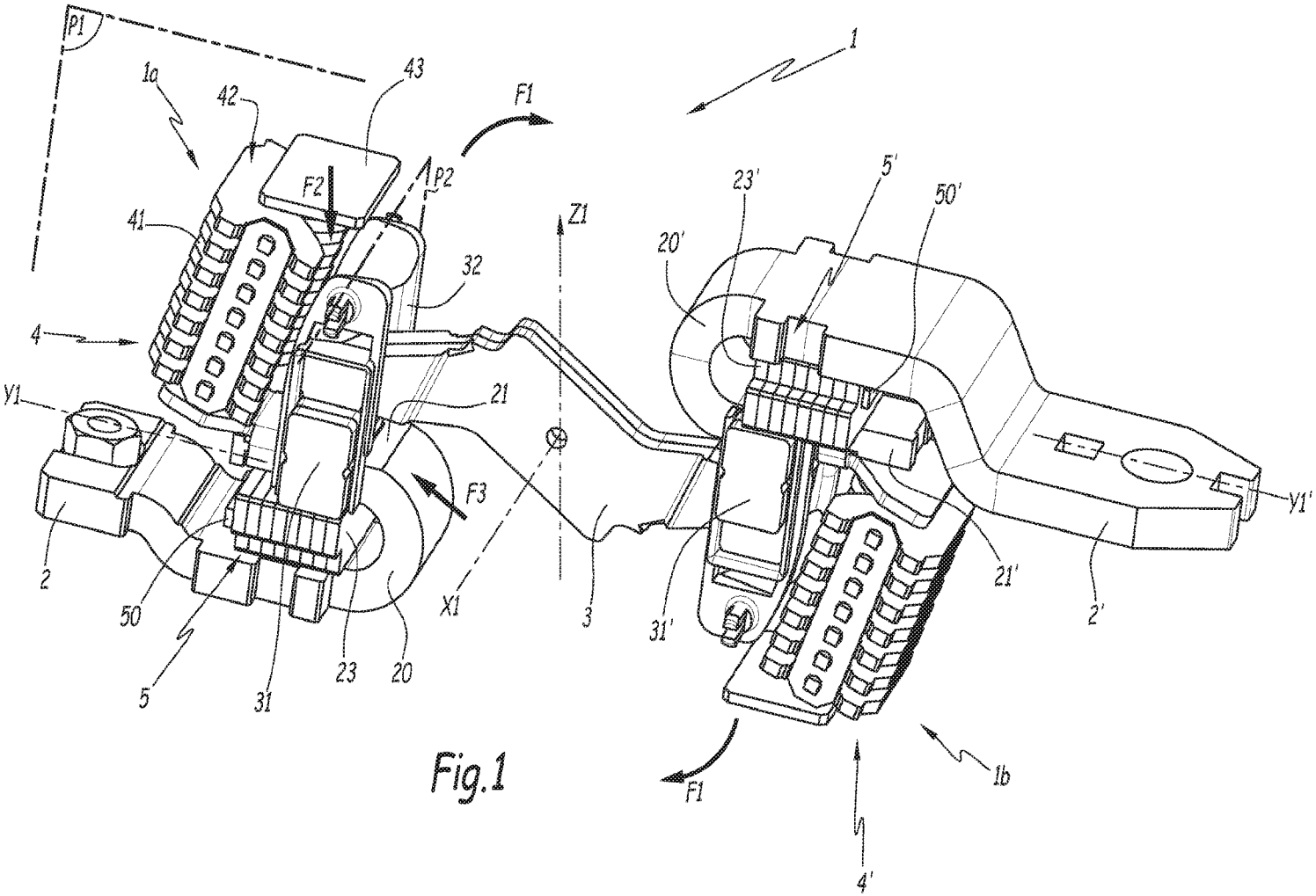
FIG. 1 is a schematic representation according to a perspective view of an internal portion of a DC electrical circuit breaker in accordance with the invention.
Figure 4:
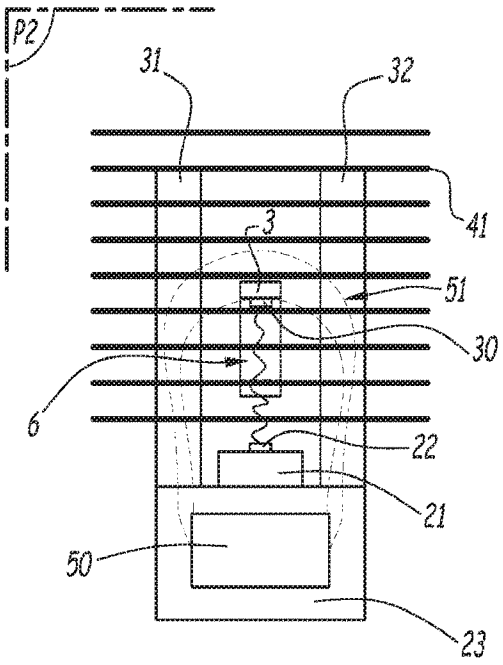
Figure 3:
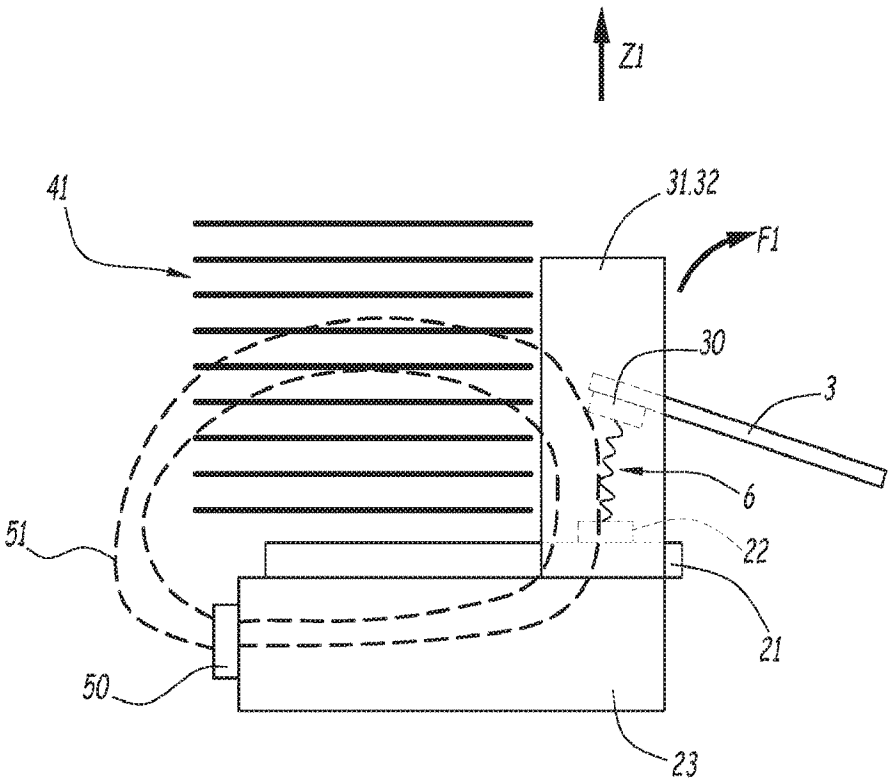
Figure 7:
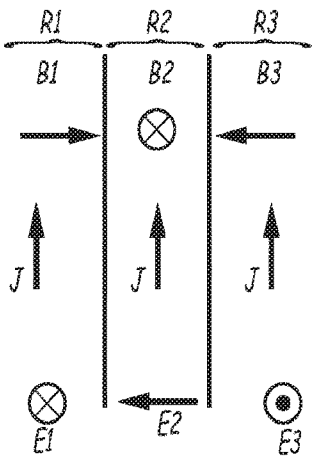
Figure 6:
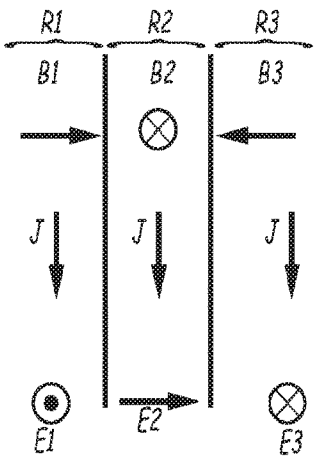
Figure 5:
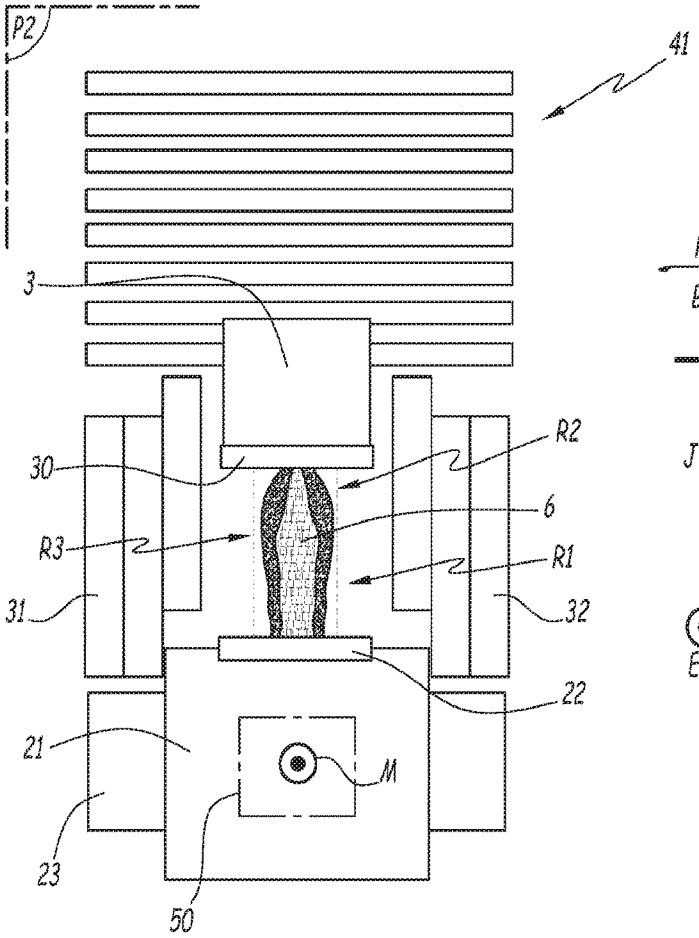

FIGS. 3 and 4 schematically represent magnetic field lines created by the magnetic circuit of the circuit breaker of FIG. 1, according to the views in longitudinal section in the plane P1 and transverse section in the plane P2 of FIG. 1;

FIG. 5 is a schematic representation of a portion of the circuit breaker of FIG. 1, along the sectional plane P2 of FIG. 1;

FIGS. 6 and 7 schematically represent the direction of an electromagnetic force exerted on an electric arc for two opposite directions of flow of the electric current in the circuit breaker of FIG. 1.

FIG. 1 represents a part of an air-quenched DC circuit breaker 1. The circuit breaker 1 here comprises a closed housing, inside which are placed components of this circuit breaker 1. This housing is for example made of a thermoformed plastic. For greater clarity, the housing of the circuit breaker 1 is not represented in FIG. 1.

The circuit breaker 1 comprises electrical terminals 2 and 2' for the input and output of an electric current. The terminals 2 and 2' are configured to electrically link the circuit breaker 1 to an electrical circuit that one wishes to protect. The terminals 2 and 2' are made of an electrically conducting material, for example a metal such as copper. These terminals 2 and 2' are here accessible from outside the housing so as to link the circuit breaker 1 to the circuit to be protected.

In this example, the polarities of the circuit breaker 1 are reversible, that is to say the terminals 2 and 2' may alternatively and interchangeably serve as input or output terminals for the electric current in the circuit breaker 1.

The circuit breaker 1 here comprises two sub-assemblies 1*a* and 1*b* each associated with a terminal 2, 2'. The first sub-assembly 1*a* comprises the following elements: a first electrical contact 21 linked to the terminal 2, an arc quenching chamber 4 and a magnetic circuit 5. The second sub-assembly 1*b* comprises the following elements: an electrical contact 21' linked to the terminal 2', an arc quenching chamber 4' and a magnetic circuit 5'.

Each of these two sub-assemblies 1*a* and 1*b* described operates in an analogous manner. Hence, only the first sub-assembly is described in detail in what follows.

In this example, the elements of the second sub-assembly 1*b* are identical and have an analogous function to those of the first sub-assembly 1*a*. The elements of the second sub-assembly 1*b* bear the same numerical reference as those of the first sub-assembly 1*a*, augmented by the symbol "'". For example, the contact 21' is analogous to the contact 21, and differs therefrom here only by its position in the circuit breaker 1.

The circuit breaker 1 furthermore comprises a movable part 3, displaceable in rotation around a fixed axis X1 of the circuit breaker 1. For example, the movable part 3 is mounted pivotably about an axis around a shaft integral with the housing of the circuit breaker 1. The movable part 3 is here electrically conducting between opposite contact zones 30 and 30'.

"P1" denotes a longitudinal geometric plane of the circuit breaker 1. In this example, the plane P1 forms a plane of symmetry of the circuit breaker 1. Here, the elements of the circuit breaker 1 are furthermore disposed symmetrically with respect to the axis X1. The axis X1 is perpendicular to the plane P1. "Z1" denotes a geometric axis perpendicular to the axis X1 and contained in the plane P1 and which here defines a vertical direction.

The electrical contact 21 is provided with a contact zone 22 intended to be placed in contact with the corresponding zone 30 of the part 3. For example, the contact zones 22 and 30 each comprise an electrically conducting contact pad, for example made of a metallic material, such as silver or copper.

The electrical contact 21 is linked electrically to the terminal 2, whereas the movable part 3 is connected electrically to the terminal 2', as explained in what follows.

Here, the contact 21 is fixed with respect to the circuit breaker 1.

In this example, the electrical contact 21 takes the form of a bar made of an electrically conducting material, for example copper, which extends parallel to a fixed axis Y1 of the circuit breaker. The axis Y1 extends here longitudinally with respect to the plane P1 and in a horizontal direction. In this illustrative example, the electrical contact 21 is formed in one piece with the terminal 2. More precisely, the bar comprises two superposed straight portions, extending parallel to one another along the axis Y1 and linked together by a portion 20 of this bar, this portion 20 being curved into the shape of a "U". The contact zone 22 is made on one of the straight portions of the electrical contact 21. The part of the terminal 2 which is intended to be linked to the outside is made on the opposite straight portion of the electrical contact 21. More precisely, the contact zone 22 is made on an upper part of the electrical contact 21 facing the corresponding contact zone 30 of the movable part 3.

The movable part 3 here plays the role of electrical contact in relation to the electrical contact 21.

The movable part 3 and the electrical contact 21 are displaceable with respect to one another, selectively and reversibly between closed and open positions. In the closed position, the contact zones 22 and 30 are in direct contact with one another so as to permit the flow of the electric current between the movable part 3 and the electrical contact 21. In the open position, the contact zones 22 and 30 are remote from one another, thereby preventing the flow of the electric current when no electric arc is present between the contacts 22 and 30. For example, in this open position, the contact zones 22 and 30 are at least 5 mm apart, preferably at least 15 mm apart.

The arrows F1 illustrate the direction of displacement of the movable part 3 from the closed position to the open position.

In this example, the displacement of the movable part 3 between the closed and open positions is effected along the plane P1, that is to say the trajectory of the contact zone 30 during the displacement is parallel to the plane P1. In the open position, the contact zones 21 and 30 are essentially aligned along an axis parallel to the axis Z1.

The part 3 is here connected indirectly to the terminal 2', by way, in particular, of the electrical contact 21' of the second sub-assembly 1*b*.

Open and closed positions of the movable part 3 with respect to the electrical contact 21' are defined analogously. The electrical contact 21' extends here along a fixed axis Y1' parallel to the axis Y1.

The circuit breaker 1 is arranged in such a way that the part 3 is simultaneously either in the open position, or in the closed position, in relation to the electrical contacts 21 and 21'. Thus, by symmetry, the displacement towards the open position is made simultaneously for each of these two sub-assemblies 1*a* and 1*b*. When the movable part 3 is in the closed position, the electric current can flow between the terminals 2 and 2' while passing through the contact zones 21 and 21', through the movable part 3 and through their respective contact zones. The displacement of the movable part 3 towards its open position is aimed at preventing the flow of this electric current between the terminals 2 and 2'. When the movable part 3 is in the open position, in the absence of any electric arc between the respective contact zones of the electrical contacts 21, 21' and the movable part 3, the electric current is prevented from flowing between the terminals 2 and 2'.

In a known manner, when the movable part 3 is displaced towards the open position while an electric current flows between the terminals 2 and 2', an electric arc may form between the two contact zones 22 and 30. This electric arc allows the electric current to continue to flow and must be extinguished in order to interrupt this electric current.

The circuit breaker 1 also comprises a tripping circuit, not illustrated, configured to automatically displace the movable part 3 towards the open position when an operating anomaly is detected, such as a surge in the electric current which flows between the terminals 2 and 2'.

For example, the chamber 4 is at least partly delimited by walls of the housing of the circuit breaker.

In a known manner, the quenching chamber 4 comprises a stack of electrically conducting arc quenching plates 41 superposed one above the other. These plates are intended to extinguish the electric arc once this electric arc has penetrated inside the quenching chamber 4. In this example, these plates are identical to one another and exhibit a plane form, inscribed within a quadrilateral and in which plates is made an essentially "V"-shaped incision on an edge pointing towards the zones 22 and 30. The stack of plates 41 is surmounted by an upper arc horn 43 disposed above an end plate 42 of the stack.

In this example, the circuit breaker 1 comprises an arc formation chamber. This chamber is, for example, at least partly defined by internal walls of the housing of the circuit breaker 1. The contact zones 22 and 30 are situated inside this arc formation chamber. The arc formation chamber is in communication with the quenching chamber 4 and emerges inside the latter. The arc formation chamber and the quenching chamber 4 are both filled with air.

"P2" denotes a geometric plane perpendicular to the plane P1 and extending in the direction Z1. The plane P2 here forms a longitudinal sectional plane of the arc formation chamber.

By way of example, the arc formation chamber exhibits a prism shape with parallelepipedal base whose lateral faces parallel to the plane P1 are formed by the lateral walls 31, 32.

In this example, the circuit breaker furthermore comprises lateral walls 31 and 32, which delimit opposite faces of this arc formation chamber parallel to the plane P1. Here, the walls 31 and 32 exhibit an essentially plane form parallel to the plane P1. The opposite walls 31 and 32 are disposed on either side of the contact zones 22 and 30 while facing one another. For example, the walls 31 and 32 are made of a ferromagnetic material, such as steel or iron.

By way of illustration, the walls 31 and 32 are each placed at a distance of between 10 mm and 100 mm from the contact zone 22, this distance being measured in a direction parallel to the axis X1.

The magnetic circuit 5 is configured to generate a magnetic field able to guide, in the direction of the quenching chamber 4, an electric arc 6 forming between the contact zones 22 and 30 subsequent to the displacement, towards the open position, of the movable part 3. On account of the arrangement of the contact zones 22 and 30 in the open position, the electric arc 6 extends essentially along a direction parallel to the plane P1 and to the axis Z1.

Everything described with reference to the magnetic circuit 5 applies equally to the magnetic circuit 5' in relation to the corresponding elements of the sub-assembly 1*b*.

Figure 2:
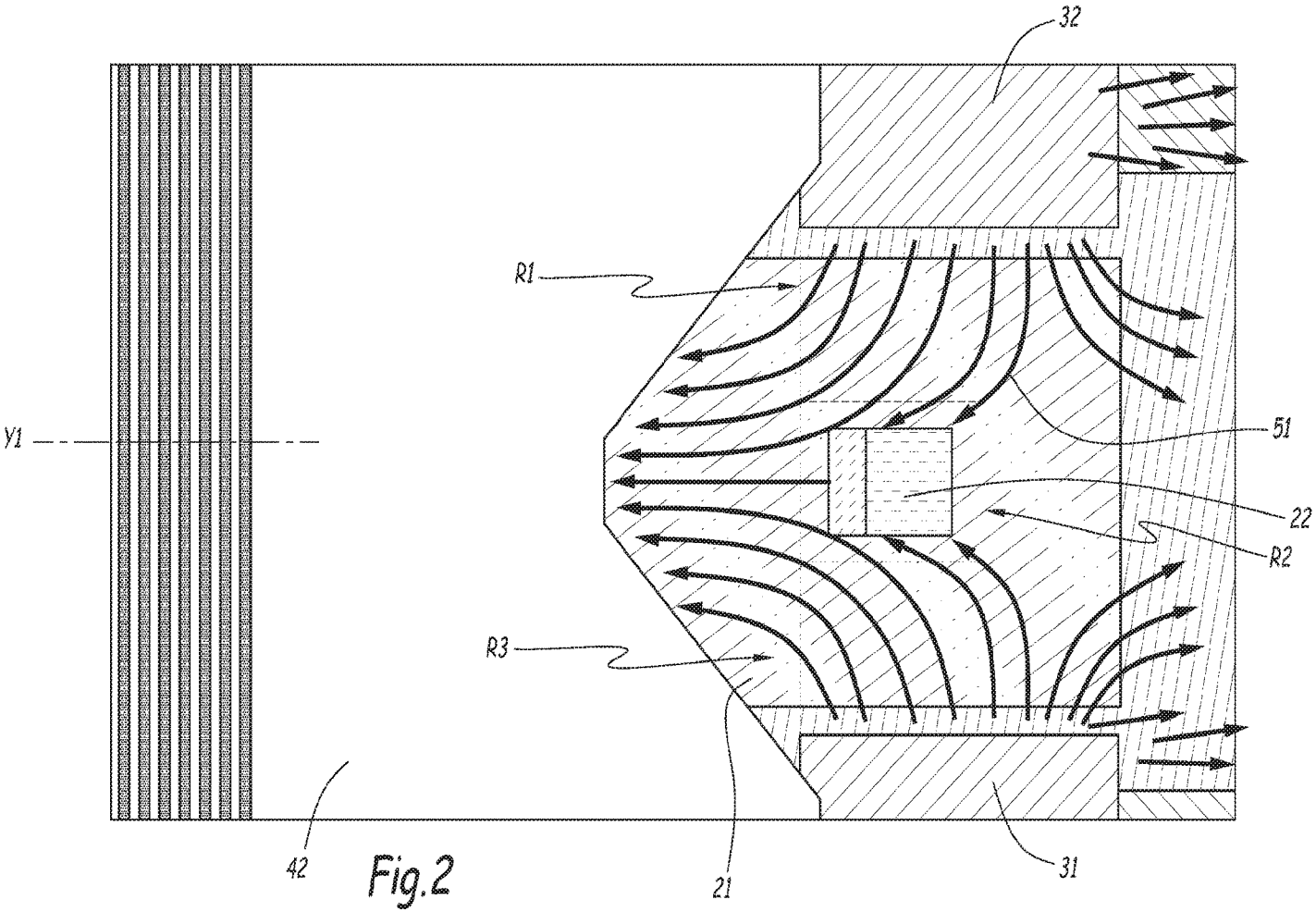
FIG. 2 is a schematic representation, of a portion of the circuit breaker of FIG. 1, according to the view illustrated by the arrow F2 of FIG. 1.

FIG. 2 represents the arc formation chamber and of the quenching chamber, in a view from above along the arrow F2 of FIG. 1. The reference 51 designates the magnetic field lines associated with the magnetic field created by the magnetic circuit 5.

"R2" denotes a central region of the arc formation chamber, here delimited on either side by geometric planes parallel to the plane P1 on either side of the contact 22 and extending along the axis Z1.

The central region R2 encompasses the contact zones 22 and 30. Here it exhibits a prism shape, whose lower base is formed by part of the upper surface of the electrical contact 21, and extends heightwise essentially parallel to the vertical direction Z1.

"R1" and "R3" denote two lateral regions of the arc formation chamber which are displaced laterally on either side of the central region R2. Here, these lateral regions R1 and R3 are delimited laterally externally by the walls 31 and 32. The regions R1 and R3 do not contain the contact zones 22 and 30.

The magnetic circuit 5 is shaped in such a way that:

- in the lateral regions R1 and R3, the field lines 51 extend essentially perpendicularly to the lateral walls 31 and 32, and
- in the central region R2, the field lines 51 extend essentially parallel to the plane P1 while converging towards the quenching chamber 4. For example, in the central region, the magnetic flux is such that the magnetic field seen by the arc is greater than or equal to 20 microTeslas.

FIGS. 3 and 4 represent these field lines 51 according to views in the planes P1 and P2 respectively.

FIG. 5 represents the arc formation chamber and the quenching chamber 4 in the sectional plane P2, according to the angle of view illustrated by the arrow F3 in FIG. 1. The movable part 3 is illustrated in the open position.

In this example, field lines 51 in FIG. 2 are calculated by means of a finite element numerical simulation program, such as the software known by the commercial name "Flux" and marketed by the company CEDRAT.

The magnetic circuit 5 here comprises a permanent magnet 50 and a ferromagnetic core 23 whose function is to at least partially guide the magnetic field created by the magnet 50. The core 23 extends at least partly along the electrical contact 21, along the axis Y1. The walls 31 and 32 here form part of the magnetic circuit 5 and participate in guiding the magnetic flux created by the magnet 50 in particular to obtain the spatial disposition of the field lines 51.

In this example, the core 23 exhibits a rectilinear rod shape which extends between the two straight portions of the electrical contact 21. This core 23 is made here in the form of a stack of ferromagnetic metal sheets. As a variant, the core 23 is formed of a one-piece component.

The magnet 50 is here fixed, for example by gluing, onto an end of this component 23, here onto the end situated opposite the U-shaped part 20.

The magnet 50 is able to generate a magnetic field of greater than or equal to 0.5 teslas or, preferably greater than or equal to 1 tesla and here exhibits a magnetic axis of magnetization M oriented parallel to the axis Y1.

Preferably, the magnet 50 is a permanent magnet, for example made of a synthetic alloy containing an element from the rare earth family. Here, use is made of a samarium-cobalt alloy. Advantageously, the magnet 50 is surrounded by a protective casing made of an amagnetic material, such as plastic.

Here, the spacing between the magnet 50 and that end of the core 23 on which it is placed, is less than or equal to 2 mm or, preferably, less than or equal to 1 mm, or else preferably zero, that is to say equal to 0 mm. This spacing is here measured as being the distance between the adjacent edges of the magnet 50 and of the end of the core 23. By reducing the separation between the magnet 50 and this end of the core 23 as much as possible, the gap between the magnet 50 and the core 23 is decreased, thereby making it possible to ensure better channelling of the magnetic flux generated by the magnet 50.

FIG. 6 represents the directions of the magnetic field created by the magnetic circuit 5 according to a view in the plane P2 from the quenching chamber 4.

We denote by:

"B1", "B2" and "B3" the magnetic induction vectors in the regions, respectively R1, R2 and R3 of the arc formation chamber;

"J" the electric current density vector associated with the electric arc 6;

"E1", "E2" and "E3" the electromagnetic force exerted on the electric arc 6 under the action of the magnetic field created by the magnetic circuit 5, for each of these regions R1, R2 and R3.

The vector J is here parallel to the direction Z1.

The electromagnetic forces E1, E2 and E3 are Lorentz forces and are proportional to the vector product between the vector J and to the magnetic induction, respectively, B1, B2 and B3 in the corresponding region R1, R2 or R3. In this example, on account of the orientation of the field lines 51 and of the direction of the current J, the forces E1 and E3 have directions parallel to the axis Y1 and have opposite directions. The force E2 is directed parallel to the axis X1.

Thus, when an electric arc 6 forms between the contact zones 22 and 30, it experiences a force E2 which directs it firstly towards one of the lateral regions, in this instance here the lateral region R3. On account of the perpendicular orientation of the vector B3 with respect to the vector B2 and of the direction of the vector J, the force E3 exerted on the electric arc 6, when it is situated in the lateral region R3, is directed towards the inside of the quenching chamber 4 and hence towards the stack of quenching plates 41. The electric arc 6 is therefore displaced towards the chamber 4 by the force E3.

FIG. 7 is analogous to FIG. 6 and differs therefrom only by the direction of flow of the electric current J in the electric arc 6, this direction being reversed with respect to that illustrated in FIG. 6. In this case, it is noted that the force E2 exerted on the electric arc 6, when it is in the region R2 between the contact zones 22 and 30, is such that the electric arc 6 is displaced towards the lateral region R1 opposite the lateral region R3. However, on account of the relative orientation of the vector B1 with respect to the vector B2 and on account of the change of sign of the vector J with respect to the case of FIG. 6, the force E1 directs the electric arc 6 towards the quenching chamber 4.

Thus, by virtue of the magnetic circuit 5, in particular on account of the spatial disposition of the field lines 51, the electric arc 6 is displaced towards the quenching chamber 4 regardless of the direction of flow of the electric current and regardless of its intensity value. Even if the intensity of the electric arc current 6 is low, the electric arc 6 will be displaced into a region where the electromagnetic force E1 or E3 is sufficient to displace it towards the quenching chamber 4. The operation of the circuit breaker 1 is thereby improved.

The magnetic circuit 5 can be produced differently.

As a variant, the movable part 3 is linked directly to the terminal 2', the second sub-assembly 1*b* then being omitted.

The embodiments and variants envisaged above may be combined together to generate new embodiments.

The invention claimed is:

1. A DC electrical circuit breaker, comprising:

first and second terminals for a DC electric current, first and second electrical contacts, connected respectively to the first and second terminals and being selectively displaceable with respect to one another, along a longitudinal plane of the circuit breaker, between:

a closed position, in which respective contact zones of the first and second electrical contacts are in contact with one another and being configured to permit flow of the DC electric current between the first and second electrical contacts, and an open position, in which the respective contact zones are remote from one another;

an electric arc formation chamber, in which the contact zones are disposed;

an electric arc quenching chamber; and a magnetic circuit comprising a magnet, and a magnetic core extending at least partly along the first electrical contact, the magnetic circuit generating a magnetic field configured to guide, in a direction of the electric arc quenching chamber, an electric arc formed between the contact zones in the open position, the magnetic field having curved field lines extending essentially perpendicularly to opposite lateral walls of the electric arc formation chamber, the lateral walls being disposed on either side of the contact zones and being essentially parallel to the longitudinal plane, the curved field lines converging, at a level of a central region of the electric arc formation chamber containing the contact zones, towards the electric arc quenching chamber while extending parallel to the longitudinal plane.

2. The circuit breaker according to claim 1, wherein the magnetic core is made of a ferromagnetic material, the magnet being placed at one of the ends of the magnetic core.

3. The circuit breaker according to claim 2, wherein the magnet exhibits a magnetic axis oriented parallel to a longitudinal direction contained in the longitudinal plane.

4. The circuit breaker according to claim 3, wherein a spacing between the magnet and the one of the ends of the magnetic core is less than or equal to 2 mm.

5. The circuit breaker according to claim 1, wherein the magnet is a permanent magnet.

6. The circuit breaker according to claim 1, wherein the magnet is made of a synthetic alloy containing a rare earth element.

7. The circuit breaker according to claim 1, wherein the magnet is configured to generate a magnetic field of greater than or equal to 0.5 tesla.

8. The circuit breaker according to claim 1, wherein the magnetic core is made of steel or iron.

9. The circuit breaker according to claim 1, wherein the lateral walls are made of a ferromagnetic material.

10. The circuit breaker according to claim 3, wherein a spacing between the magnet and the one of the ends of the magnetic core is less than or equal to 1 mm.

11. The circuit breaker according to claim 1, wherein the magnet is made of a samarium-cobalt alloy.

12. The circuit breaker according to claim 1, wherein the magnet is configured to generate a magnetic field of greater than or equal to 1 tesla.

13. The circuit breaker according to claim 1, wherein the electric arc quenching chamber is disposed adjacent to and in communication with the electric arc formation chamber, such that the electric arc formation chamber extends into the electric arc quenching chamber.

14. The circuit breaker according to claim 1, wherein the electric arc formation chamber has a prism shape with a parallelepipedal base, lateral faces of the electric arc formation chamber being formed by the opposite lateral walls.

15. A DC electrical circuit breaker, comprising:

first and second terminals for a DC electric current, a pair of first electrical contacts respectively connected to the first and second terminals and a pair of second electrical contacts being electrically connected to one another, each second electrical contact of the pair of second electrical contacts being selectively displaceable with respect to a corresponding first electrical contact of the pair of first electrical contacts, along a longitudinal plane of the circuit breaker, between:

a closed position, in which contact zones of said each second electrical contact and said corresponding first electrical contact are in contact with one another and are configured to permit flow of the DC electric current therebetween, and an open position, in which the contact zones are separated from one another;

a pair of electric arc formation chambers in which the contact zones are respectively disposed;

a pair of electric arc quenching chambers, each electric arc quenching chamber of the pair of electric arc quenching chambers being disposed adjacent to a corresponding electric arc formation chamber of the pair of electric arc formation chambers; and a pair of magnetic circuits each comprising a magnet, and a magnetic core extending at least partly along a respective first electrical contact of the pair of first electrical contacts, each magnetic circuit of the pair of magnetic circuits generating a magnetic field configured to guide, in a direction of the respective electric arc quenching chambers, electric arcs formed between the contact zones in the open position, the magnetic field having curved field lines extending essentially perpendicular to opposite lateral walls of the respective electric arc formation chambers, the lateral walls being disposed on either side of the contact zones and being essentially parallel to the longitudinal plane, the curved field lines converging, at a level of a central region of each of the electric arc formation chambers containing the respective contact zones, towards a corresponding electric arc quenching chamber of the pair of electric arc quenching chambers while extending parallel to the longitudinal plane.

* * * * *